US005857804A

United States Patent [19]

Musil

[11] Patent Number: 5,857,804

[45] Date of Patent: Jan. 12, 1999

[54] ASPHALT PAVER HAVING AUGER EXTENSIONS FOR EXTENDED SCREEDS

[75] Inventor: Joseph E. Musil, Ely, Iowa

[73] Assignee: Cedarapids, Inc., Cedar Rapids, Iowa

[21] Appl. No.: 700,211

[22] Filed: Aug. 20, 1996

[51] Int. Cl.[6] ..... E01C 19/48

[52] U.S. Cl. ..... 404/104; 404/108

[58] Field of Search ..... 404/104, 101, 404/106, 108, 114, 96, 105

[56] References Cited

U.S. PATENT DOCUMENTS

| | | | |
|---|---|---|---|
| 4,062,196 | 12/1977 | Yoshida et al. | 405/184 |
| 4,682,908 | 7/1987 | Domenighetti | 404/84 |
| 4,702,642 | 10/1987 | Musil | 404/118 |
| 4,749,304 | 6/1988 | Craig | 404/101 |
| 4,772,156 | 9/1988 | Craig | 404/104 X |
| 5,120,155 | 6/1992 | Samspon | 404/110 |
| 5,529,434 | 6/1996 | Swisher, Jr. | 404/108 |
| 5,549,414 | 8/1996 | Boxall et al. | 404/101 |

*Primary Examiner*—James Lisehora

*Attorney, Agent, or Firm*—Marshall, O'Toole, Gerstein, Murray & Borun

[57] ABSTRACT

An improved extended auger arrangement and an improved asphalt paver with a tractor unit and a screed assembly, including a main screed and extendable screeds, having such an improved extended auger arrangement, the extendable screeds extending laterally outwardly from the main screed such that the screed assembly spans a width substantially greater than the width of the tractor unit. The extended auger arrangement includes a pair of opposing, oppositely pitched, inner augers, rotatable about a substantially horizontal axis oriented perpendicularly to the direction of travel of the tractor unit and approximately spanning the width of the tractor unit, and a pair of oppositely pitched outer augers, rotatable about respective horizontal axes oriented substantially non-perpendicularly to the direction of travel of the tractor unit and approximately spanning the difference between the width of the tractor unit and the width of the screed assembly. Each of the outer augers is drivingly and pivotally connected by a universal joint to a respective one of the inner augers. A supporting structure provides fore-and-aft support for the outer augers.

21 Claims, 1 Drawing Sheet

FIG. 1
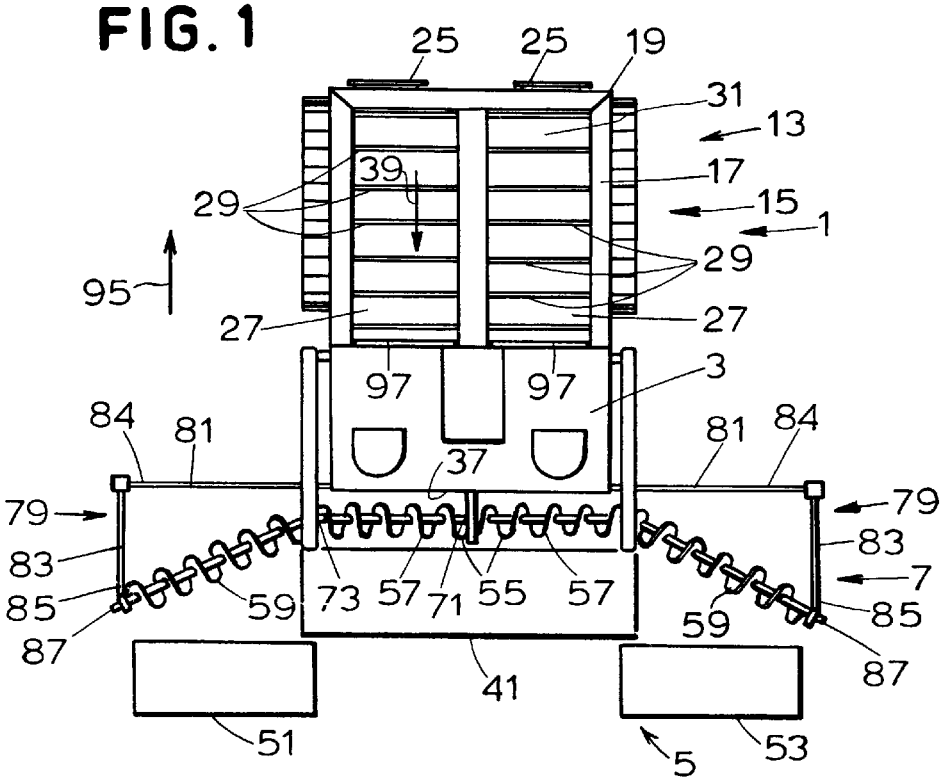
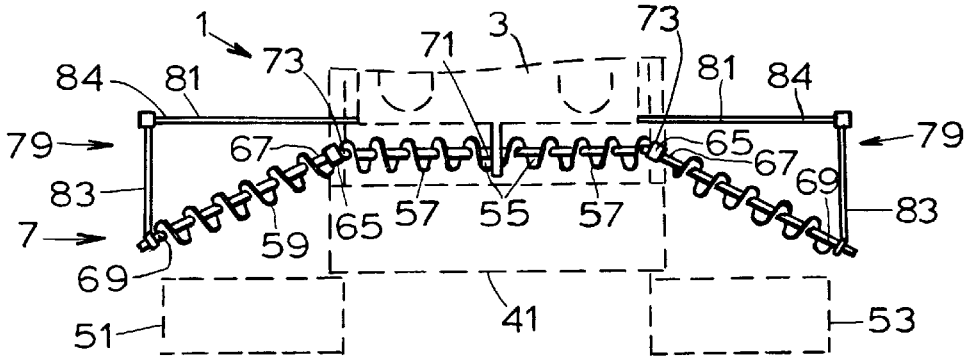
FIG. 2
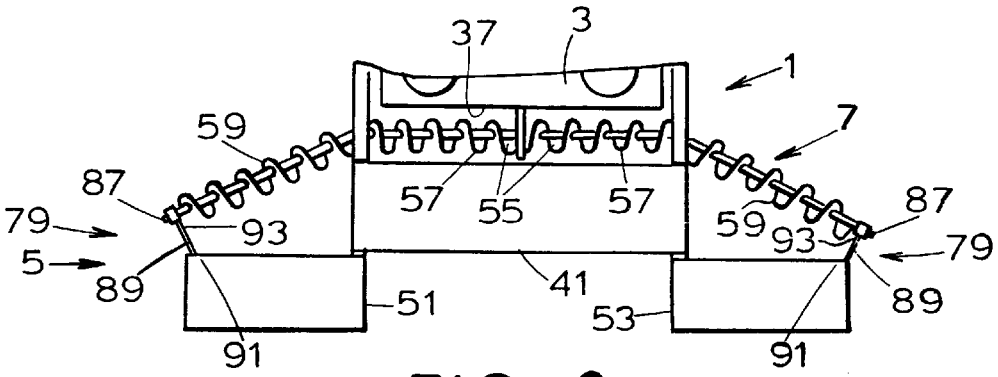
FIG. 3

ASPHALT PAVER HAVING AUGER EXTENSIONS FOR EXTENDED SCREEDS

BACKGROUND OF THE INVENTION

1. Field of the Invention

The present invention relates generally to asphalt pavers and, more particularly, to asphalt pavers having laterally extendable screeds.

2. Description of the Related Art

Most paving machines for laying bituminous or asphaltic material roadways are of the so-called "floating screed" type. Each employs a tracked or wheeled tractor unit having a pair of rearwardly extending screed pull arms pivotally attached to the sides of the tractor unit. A screed assembly of the paving machine is attached to rearwardly projecting distal ends of the pull arms.

For this type of paving machine, the texture and density of a mat of asphaltic material placed by the paving machine is influenced by the weight of the screed assembly, which "floats" upon the asphaltic material therebeneath, and by the angular attitude of the underlying screeding surface of the screed assembly relative to the roadway, commonly referred to as the "attack angle" of the screed. For a given speed of the paving machine and the thicker the mat being laid by the machine, the greater the attack angle must be in order to achieve a desired density of the mat being placed by the machine. Hence the screed assembly, in turn, should be pivotally adjustable about a transverse horizontal axis such that the attack angle can be dynamically adjusted as operating conditions dictate.

A typical width of a main screed of the screed assembly of a paving machine for highway construction and the like approximates the overall width of the paving machine, or approximately ten feet for example. In order to lay a mat of greater width and thereby reduce the number of passes needed for a particular project, laterally extendable screed assemblies are commonly used.

Such extendable screed assemblies generally include a pair of shorter screeds, or "screed extensions", carried by and disposed rearwardly of the main screed. The screed extensions are generally attached to the main screed such that one or both of the screed extensions can be slidably adjusted outwardly from the main screed, thereby extending the effective width of the screed assembly. For example, the screed extensions may be extended outwardly such that the overall width of the screed assembly—the main screed plus two screed extensions, one to the left and one to the right—ranges up to approximately twice the width of the main screed, or approximately twenty feet for example. The overall width of the mat laid in a single pass of the paving machine is thereby increased. As a result and in terms of time and therefore cost of paving a given roadway, the efficiency of the paving machine is also increased by utilizing the extendable screeds.

Prior art paving machines utilizing screed extensions typically use an opposing pair of augers situated at the rear of the paver and extending perpendicularly outwardly to laterally distribute asphaltic material from immediately behind the paving machine to approximately the paths to be traversed by the outer extremities of the auger extensions. The outer ends of these augers generally are either unsupported or are supported off of the paving machine. The augers are generally pitched and rotated such that the asphaltic material is urged outwardly and forwardly relative to the direction of travel of the paving machine.

Various interrelated factors contribute to distribution of asphaltic material to the outer extremities of the auger extensions. Such factors include the rate at which asphaltic material is deposited by the paving machine on the subgrade at the rear of the paving machine, the speed of the paving machine, the extent to which the perpendicularly oriented auger extensions reach outwardly from the paving machine, the screw pitch of the augers, the rate of rotation of the augers, the thickness of the mat being laid by the paving machine, etc.

Due to the forward motion of the paving machine, the farther the auger extensions extend outwardly from the paving machine, the greater the amount of asphaltic material that must be accumulated and pushed in front of the augers in order for sufficient asphaltic material to be urged laterally in order to reach the outer extremities of the auger extensions in sufficient quantity to provide a mat of asphaltic material having the desired thickness at those outer extremities of the screed extensions. Unfortunately, the greater the quantity of asphaltic material that must be accumulated and pushed in front of the augers as aforesaid, the greater the power demands placed on the prime mover of the paving machine. Further, the greater the power demands placed on the paving machine for conveying the asphaltic material to the outer reaches of the screed extensions, the less the power available for desired traction requirements and for propulsion of the paving machine.

What is needed is an asphalt paving machine having means to laterally distribute asphalt material to outer extremities of extendable screeds thereof without unnecessarily loading a prime mover of the paving machine which, otherwise, would reduce the power available for traction requirements and propulsion of the paving machine.

SUMMARY OF THE INVENTION

An improved extended auger arrangement and an improved asphalt paver with extendable screeds having such an extended auger arrangement is provided for placing a mat of asphaltic material for paving purposes. The asphalt paver includes a tractor unit having a first width and a direction of travel, a hopper configured to receive the asphaltic material from trucks backed against and pushed by bumper rollers situated at the front of the tractor unit, parallel slat conveyors configured to convey the asphaltic material from the hopper to the rear of the tractor unit whereat the asphaltic material is deposited on the subgrade receiving the paving mat, and a screed assembly having a centrally located main screed and opposing extendable screeds extending laterally outwardly from the main screed wherein the screed assembly spans a width substantially greater than the width of the tractor unit.

The extended auger arrangement and, accordingly, the asphalt paver, having such an extended auger arrangement, are configured to laterally distribute and place the asphaltic material in a mat having a width that is substantially greater than the width of the tractor unit and approximates the width of the screed assembly. The extended auger arrangement generally includes a pair of opposing, oppositely pitched, inner augers, rotatable about a substantially horizontal axis oriented perpendicularly to the direction of travel of the tractor unit and approximately spanning the width of the tractor unit, and a pair of oppositely pitched outer augers, rotatable about respective substantially horizontal axes oriented substantially non-perpendicularly to the direction of travel of the tractor unit and approximately spanning the difference between the width of the tractor unit and the width of the screed assembly.

Each auger of the pair of outer augers is drivingly and pivotally connected end-to-end, such as by a universal joint, to a respective one of the inner augers. Also, each auger of the pair of outer augers is oriented such that a longitudinal axis thereof is angled rearwardly and outwardly from the respective inner auger to which it is connected. Preferably, each auger of the pair of outer augers is oriented such that the fore-and-aft spacing between an outer end thereof and the screed assembly is non-interferingly minimized.

The improvement generally includes a supporting structure that extends generally laterally outwardly from each side of the tractor unit terminating in a pair of opposing distal ends, wherein the supporting structure includes a pivotally mounted pull member extending generally rearwardly from each of the pair of opposing distal ends. Outer ends of axial shafts of the two outer augers are journaled to a respective one of the pull members.

Alternatively, the supporting structure may comprise a pair of opposing, push members pivotally mounted at or near opposing extremities of the extendable screeds of the screed assembly. Outer ends of axial shafts of the two outer augers are journaled to a forwardly extending distal end of a respective one of the push members.

PRINCIPAL OBJECTS AND ADVANTAGES OF THE INVENTION

The principal objects and advantages of the present invention include: providing a paving machine having auger extensions and such auger extensions for a paving machine wherein power drawn from a prime mover of the paving machine for laterally distributing asphaltic material deposited behind the paving machine to outer extremities of laterally extendable screeds of the paving machine is minimized; providing such a paving machine and such auger extensions for a paving machine wherein at least portions of the extendable screeds are angled rearwardly toward the outer extremities of the extendable screeds; and generally providing such a paving machine and such auger extensions for a paving machine, each being reliable in performance and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 1 is a diagrammatic top view of a paving machine having extendable screeds and auger extensions, according to the present invention.

FIG. 2 is a fragmentary, diagrammatic top view of the paving machine having extendable screeds and auger extensions, similar to FIG. 1 but showing portions removed to more clearly show connections between components of the auger extensions.

FIG. 3 is a fragmentary, diagrammatic top view of the paving machine having extendable screeds and auger extensions, similar to FIG. 1 but showing a different arrangement for supporting outer ends of the auger extensions, according to the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to an apparatus for producing an enlarged mat of asphaltic material for paving purposes in accordance with the present invention, as shown in FIGS. 1 through 3. The apparatus 1 generally includes a tractor unit 3, compacting means 5 for compaction of the asphaltic material, and distributing means 7 for laterally distributing portions of asphaltic material deposited behind the tractor unit 3 to outer transverse extremities of the compacting means 5 prior to the compaction of the asphaltic material. Generally, the tractor unit 3 is a state-of-the-art self-propelled construction machine designed to receive, convey, distribute, profile and compact the asphaltic material in the paving mat.

More specifically, the tractor unit 3 includes hopper means 13 for receiving and containing the asphaltic material from trucks (not shown) that are generally backed against, and pushed by, the tractor unit 3, and conveying means 15 for conveying the asphaltic material from the hopper means 13 to the rear of the tractor unit 3 whereat the asphaltic material is deposited on the subgrade for the mat.

The hopper means 13 includes a hopper 17 situated near a front end 19 of the tractor unit 3 for receiving the asphaltic material from the (unshown) trucks. The tractor unit 3 generally includes a pair of bumper rollers 25 for establishing rolling contact with one of the (unshown) trucks as the truck dumps the asphaltic material into the hopper 17.

The conveying means 15 generally comprises two parallel slat conveyors 27, each having a plurality of crossbars 29, as indicated in FIG. 1. The slat conveyors 27 each include an upper run 31 having a direction of travel from near the front end 19 of the tractor unit 3 and continuing rearwardly to near the rear 37 of the tractor unit 3, as indicated by the arrow designated by the numeral 39 in FIG. 1, such that asphaltic material is conveyed rearwardly from the hopper 17 and discharged by the slat conveyors 27 in front of the distributing means 7.

It is to be understood that the conveyor means 15 may, instead of the slat conveyors 27, comprise any other suitable arrangement for conveying the asphaltic material from the hopper 17 to the rear 37 of the tractor unit 3, such as front-to-rear auger conveyors (not shown) or the like.

The compacting means 5 includes a main screed 41 disposed at the rear 37 of the tractor unit 3, wherein the main screed 41 is configured to be "free-floating" and to operatively profile and compact the asphaltic material into a paving mat.

The compacting means 5 also includes a pair of opposing extendable screeds 51 and 53, each displaceable from a retracted configuration, wherein the extendable screeds 51 and 53 are substantially aligned with, and positioned behind, the main screed 41, to an extended configuration, wherein the extendable screeds 51 and 53 are extended substantially laterally from the main screed 41, as shown in FIG. 1.

It is to be understood that one of the extendable screeds 51 and 53 may be extended to a greater or lesser extent than the other one of the extendable screeds 53 and 51. Further, one of the extendable screeds 51 or 53 may assume the extended configuration as the other of the extendable screeds 53 or 51 assumes the retracted configuration.

The extendable screeds 51 and 53 are mounted on, and supported by, the main screed 41. An example of such an arrangement is disclosed in U.S. Pat. No. 4,702,642 entitled, "EXTENSIBLE SCREED ASSEMBLY FOR A BITUMINOUS PAVER", issued Oct. 27, 1987 to Joseph E. Musil.

The distributing means 7 generally includes a pair of opposing screw augers 55, each having an inner auger 57 and an outer auger 59. Each of the inner augers 57 is spaced between the rear 37 of the tractor unit 3 and the main screed 41. The screw augers 55 are spaced above the underlying sub-grade such that a mat formed beneath and trailing behind the screw augers 55 will have the desired thickness after being compacted by the main screed 41 and the extendable screeds 51 and 53, spaced rearwardly from the screw augers 55.

Also, the screw augers 55 are rotationally driven by the tractor unit 3 such that the lowermost extremities of the screw augers 55 travel toward the front end 19 of the tractor unit 3 such that excess asphaltic material is accumulated and pushed by the respective screw auger 55 in the direction of travel of the tractor unit 3. Also, the pitch of each of the screw augers 55 are designed such that the excess asphaltic material accumulated and pushed in front of the respective screw auger 55 is urged transversely outwardly along the respective screw auger 55 until the excess asphaltic material is depleted by formation of the mat being formed beneath the screw augers 55.

Pivotally connected to the outer end of each of the inner augers 57 is a respective one of the outer augers 59. Each of the outer augers 59 is drivingly connected to the respective inner auger 57, such as by a universal joint 65, as illustrated in FIG. 2, or other suitable arrangement. Each of the outer augers 59 angle backwardly from an inner end 67 thereof to an outer end 69 thereof. It is to be understood that, for some applications, the inner augers 57 may also angle backwardly from an inner end 71 thereof to an outer end 73 thereof to a greater or lesser extent than the outer augers 59, as desired. Generally, however, the inner augers 57 are coaxially aligned.

The inner ends 67 of the outer augers 59 are supportably located by the respective outer ends 73 of the inner augers 57. The outer ends 69 of the outer augers 59 are supportably located by auger support means 79. For some applications, the auger support means 79 is provided by laterally extending support members 81, such as a mouldboard of the tractor unit 3 or other suitable arrangement, with trailing pull members 83 attached near respective outer ends 84 of the support members 81, as illustrated in FIG. 2.

Each of the pull members 83 has a trailing distal end 85 that is journaled to a shaft 87 of the respective outer auger 59 at the outer end 69 thereof. Each of the auger support means 79 is generally configured to be readily demountable such that the pull members 83 may be disconnected from the support members 81, the support members 81 may be retracted into the tractor unit 3, the journaled ends of the pull members 83 may be slidingly removed outwardly from the outer ends 69 of the shafts 87, and the universal joints 65 may be disconnected either from the outer ends 73 of the inner augers 57 or from the inner ends 67 of the outer augers 59.

For other applications, it may be desirable to configure the auger support means 79 differently. For example, the auger support means 79 may be provided by push members 89 attached to a respective one of the extendable screeds 51 and 53 near an outer end 91 thereof, as illustrated in FIG. 3. Each of the push members 89 has a leading distal end 93 that is journaled to the shaft 87 of the respective outer auger 59 at the outer end 69 thereof. As hereinbefore described, the push members 89 and outer augers 59 are generally configured to be readily demountable.

It is to be understood that the push members 89 may be oriented either forwardly along the direction of travel of the tractor unit 3, generally perpendicularly to the respective shafts 87, or any other suitable angular orientation relative to the shafts 87 as desired.

In an application of the present invention, asphaltic material is intermittently dumped into the hopper 17 and continuously conveyed toward and deposited at the rear 37 of the tractor unit 3 by the slat conveyors 27 as the tractor unit 3 is propelled forwardly in the direction of the arrow designated by the numeral 95. Assuming that the tractor unit 3 is propelled at a constant speed and that the slat conveyors 27 operate at a speed that is determined by the speed of tractor unit 3, the rate at which asphaltic material is deposited at the rear is controlled by the separation between a pair of gates 97 and the upper run 31 of the slat conveyors 27.

As the asphaltic material is deposited as the rear 37 of the tractor unit 3, the rotating inner augers 57 urges the asphaltic material laterally outwardly toward the laterally outer extremities of the main screed 41. The inner augers 57 are spaced sufficiently above the underlying subgrade such that the quantity of asphaltic material which passes beneath the inner augers 57 forms a mat that will have a desired thickness after the asphaltic material passes beneath, and is compacted by, the main screed 41.

The asphaltic material is discharged from the rear 37 of the tractor unit 3 at a rate that is greater than the rate at which the asphaltic material is used to form the mat that passes beneath the inner augers 57. As a result, the excess asphaltic material accumulates in front of the inner augers 57 and is urged laterally outwardly.

As the excess asphaltic material is urged beyond the outer ends 73 of the inner augers 57, the outer augers 59 are propelled into that excess asphaltic material by the forward motion of the tractor unit 3. The outer augers 59 are drivingly rotated by the inner augers 57 through the universal joints 65. Thus, as the rotating outer augers 59 contact the excess asphaltic material urged into the paths of the outer augers 59, the excess asphaltic material is urged further outwardly by the outer augers 59.

As before, the outer augers 59 are spaced sufficiently above the underlying subgrade whereby the quantity of asphaltic material that passes beneath the outer augers 59 forms a mat that will have a desired thickness after the asphaltic material passes beneath, and is compacted by, the respective extendable screeds 51 and 53.

Desirably, the quantity of excess asphaltic material urged in the path of the outer augers 59 by the inner augers 57 is sufficient whereby the portions of the mat formed by the outer augers 59 and the extendable screeds 51 and 53 will have the desired thickness, consistent with the mat formed by the inner augers 57 and the main screed 41, and will have the desired lateral widths. If desired, a cut-off shoe (not shown) may be used to form a more defined edge at the desired extremities of the lateral widths of the portions of the mat formed by the outer augers 59 and the extendable screeds 51 and 53.

If the lateral widths of the portions of the mat formed by the outer augers 59 and the extendable screeds 51 and 53 are less than desired, then the quantity of asphaltic material being discharged from the tractor unit 3 for a particular forward speed of the tractor unit 3 must be increased. Such correction can be readily accomplished by an operator of the tractor unit 3 by simply increasing the separation between the gates 97 and the upper runs 31 of the slat conveyors 27.

It is to be understood that other modifications in operating parameters may be utilized to adjust the lateral widths of the portions of the mat formed by the outer augers 59 and the extendable screeds 51 and 53, such as by adjusting the speed of the upper runs 31 of the slat conveyors 27 relative to the forward speed of the tractor unit 3, etc., or by altering various operating parameters in combination. It is also to be understood that similar modifications must be made to the operating parameters to adjust those lateral widths to compensate for variations in the elevation of the subgrade, which will obviously affect the quantity of excess asphaltic material accumulated in front of the screw augers 55.

It should further be understood that the lateral widths of the portions of the mat formed by the outer augers 59 and the extendable screeds 51 and 53 may be intentionally reduced below the full available widths by similarly modifying those operating parameters.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for placing a mat of asphaltic material, comprising a tractor unit having a first width and a direction of travel; said tractor unit further having:

a) hopper means for receiving and containing the asphaltic material;

b) conveyor means for conveying the asphaltic material from said hopper means and for discharging the asphaltic material from said tractor unit;

c) distributing means for laterally distributing the asphaltic material and for placing the asphaltic material in a mat having a second width substantially greater than said first width, wherein at least a portion of said distributing means is rotated about a substantially horizontal axis oriented non-perpendicularly to said direction of travel said distributing means further including a pair of opposing inner augers approximately spanning said first width and a pair of outer augers, each outer auger being drivingly and pivotally connected end-to-end to a respective one of said inner augers; and d) screed means for compacting the mat of asphaltic material.

2. The apparatus of claim 1, wherein each of said outer augers is oriented such that a longitudinal axis thereof is angled rearwardly and outwardly from its adjacent said inner auger.

3. The apparatus of claim 1, wherein each of said outer augers is oriented such that the fore-and-aft spacing between an outer end thereof and said screed means is non-interferingly minimized.

4. The apparatus of claim 1, wherein each of said outer augers is connected to respective said inner auger by a universal joint.

5. An apparatus for an asphalt paver adapted to produce a mat of asphaltic material wherein the asphalt paver has a first width, an extendable screed assembly having a second width substantially greater than said first width, a direction of travel, and means for depositing the apshaltic material in the path of the extendable screed assembly wherein a width of the apshaltic material being deposited is not greater than the first width; said means for distributing comprising:

auger means for laterally distributing the apshaltic material such that a mat of the asphaltic material is formed in front of the extendable screed assembly wherein the mat has a width approximately equal to the second width; said auger means having at least one first auger oriented generally perpendicular to the direction of travel of the asphalt paver and at least one second auger oriented substantially non-perpendicularly to the direction of travel of the asphalt paver and being drivingly connected end-to-end to said first auger.

6. The apparatus according to claim 5, wherein said at least one first auger comprises two inner augers.

7. The apparatus according to claim 6, wherein said two inner augers are oppositely pitched.

8. The apparatus according to claim 5, wherein said at least one second auger comprises two outer augers.

9. The apparatus according to claim 8, wherein said two outer augers are oppositely pitched.

10. The apparatus according to claim 8, including:

a supporting structure extending generally laterally outwardly from each side of the asphalt paver and terminating in a pair of opposing distal ends; said supporting structure including a pivotally mounted pull member extending generally rearwardly from a respective one of said pair of opposing distal ends; and each of said two outer augers having a distal end thereof journaled to a respective one of said pull members.

11. The apparatus according to claim 8, including:

a pair of opposing push members, each extending generally forwardly from a respective laterally opposing portion of the extended screed assembly; and each of said two outer augers having a distal end thereof journaled to a respective one of said push members.

12. The apparatus according to claim 5, wherein said at least one first auger comprises two inner augers and said at least one second auger comprises two outer augers.

13. The apparatus according to claim 12, wherein each of said two outer augers are oriented rearwardly and outwardly from a respective one of said two inner augers.

14. The apparatus according to claim 5, wherein said at least one second auger is drivingly connected to a respective one of said at least one first auger by a universal joint.

15. An asphalt paver adapted for movement along a path, comprising:

a frame;

an asphalt hopper supported by the frame for receiving asphaltic material;

a conveyor for discharging the apshaltic material from the hopper;

an inner auger having a pair of outer ends, the inner auger being adapted to laterally distribute the asphaltic material to a first width;

an outer auger having an inner end drivingly connected by a flexible joint to an adjacent one of the inner auger outer ends, the flexible joint permitting the outer auger to be positioned at an angle relative to the inner auger, the outer auger being adapted to laterally distribute the apshaltic material to a second width greater than the first width; and a screed assembly supported by the frame, the screed assembly being extendable to the second width.

16. An asphalt paver adapted for movement along a path, comprising:

a frame;

an asphalt hopper supported by the frame for receiving asphaltic material;

a conveyor for discharging the apshaltic material from the hopper;

an inner auger having a pair of outer ends, the inner auger being adapted to laterally distribute the asphaltic material to a first width;

a pair of outer augers, each outer auger having an inner end drivingly connected to an adjacent one of the inner auger outer ends, each of the outer augers having an outer end and being rotatable about a generally horizontal axis disposed at an angle relative to the path and being oriented so that the outer auger outer ends are disposed rearwardly of the outer auger inner ends, the outer augers being adapted to laterally distribute the apshaltic material to a second width greater than the first width; and an screed assembly supported by the frame, the screed assembly being extendable to the second width.

17. The device of claim 16, wherein the inner auger includes a pair of oppositely pitched sections.

18. The device of claim 16, wherein the outer augers are oppositely pitched.

19. The device of claim 16, wherein the inner auger is rotatable about a generally horizontal axis disposed generally perpendicular to the path.

20. The device of claim 16, including an outwardly extending subframe attached to opposite sides of the frame, and wherein each of the outer augers includes an outer end, each of the subframes having an outer end adapted to rotatably support the outer auger outer ends.

21. The device of claim 16, including a push member attached to opposite sides of the screed assembly and wherein each of the outer augers includes an outer end, each of the push members being adapted to rotatably support the outer auger outer ends.

* * * * *